United States Patent [19]

Tanabe

[11] Patent Number: 4,488,026

[45] Date of Patent: Dec. 11, 1984

[54] MICROWAVE OVEN WITH AUTOMATIC COOKING PERFORMANCE HAVING ADDITIONAL HEATING PROCESS

[75] Inventor: Takeshi Tanabe, Higashiosaka, Japan

[73] Assignee: Sharp Kabushiki Kaisha, Osaka, Japan

[21] Appl. No.: 413,711

[22] Filed: Sep. 1, 1982

[30] Foreign Application Priority Data

| | | | |
|---|---|---|---|
| Sep. 3, 1981 | [JP] | Japan | 56-139438 |
| Nov. 2, 1981 | [JP] | Japan | 56-176075 |
| Nov. 2, 1981 | [JP] | Japan | 56-176076 |

[51] Int. Cl.[3] ..... H05B 9/06

[52] U.S. Cl. ..... 219/10.55 B; 219/10.55 E; 219/10.55 M; 99/325

[58] Field of Search ..... 219/10.55 B, 10.55 E, 219/10.55 M, 10.55 R; 99/325

[56] References Cited

U.S. PATENT DOCUMENTS

| | | | |
|---|---|---|---|
| 4,162,381 | 7/1979 | Buck | 219/10.55 B |
| 4,350,860 | 9/1982 | Ueda | 219/10.55 B |
| 4,379,964 | 4/1983 | Kanazawa et al. | 219/10.55 B |

*Primary Examiner*—C. L. Albritton
*Assistant Examiner*—M. M. Lateef
*Attorney, Agent, or Firm*—Birch, Stewart, Kolasch & Birch

[57] ABSTRACT

In an automated microwave oven, a gas sensor is provided within a passageway for air leaving the heating chamber. In addition to a switching circuit for controlling an enabling circuit for a microwave source such as a magnetron, a cook switch is provided which is common to all of the different kinds of food to be heated. A microcomputer is provided which generates a heating stop instruction for the enabling circuit of the microwave source in response to both an output signal from the gas sensor and a stored program in the microcomputer. Based upon the rate of timewise variation in the output signal from the gas sensor, the microcomputer decides roughly what kind of food is being heated and then establishes an intended final level which the gas sensor should reach at the end of heating. In conjunction with the kind of food which has the lowest rate of timewise variation in the output of the gas sensor, decision is made as to whether the timewise variation in the output signal of the gas sensor after reaching a given detection level ($V_{S1}$) is greater than a predetermined timewise variation, for deciding the subkind of the food and a desired constants ($N_K$) for additional heating according to such second decision. Additional heating is effected for a length of time which is the product of the time necessary for the output signal from the gas sensor to reach the intended final level and the desired constant for additional heating so selected.

12 Claims, 8 Drawing Figures

MICROWAVE OVEN WITH AUTOMATIC COOKING PERFORMANCE HAVING ADDITIONAL HEATING PROCESS

BACKGROUND OF THE INVENTION

This invention relates to a microwave oven and especially it relates to a microwave oven which decides, from a timewise variance in a terminal voltage at a gas sensor, what kind of food is being cooked and then decides automatically when cooking of the food is to be completed.

The conventional types of automatic microwave ovens capable of deciding and automatically controlling the progress of food cooking with the aid of a sensor or sensors are provided with a predetermined number of keys each for a different kind of food by which different final cooking temperatures are preset.

The inventor of this application has made a noticeable development toward automation of cooking processes in the microwave ovens deciding what kind of food is being heated and cooked and evaluating its optimum final cooking temperature, based upon a timewise variation in a terminal voltage at a gas sensor. Such development is highly contributory to new types of microwave ovens which eliminate the need for individual presetting keys for the different kinds of food thanks to automated cooking processes, as fully disclosed in my copending application Ser. No. 39,611. However, accurate cooking is desired irrespective of the type of food cooked.

OBJECT AND SUMMARY OF THE INVENTION

Accordingly, it is an object of the present invention to provide an automatic microwave oven which assures automation of microwave heating with additional heating for an appropriate length of time.

In carrying out the above described object, the present invention provides a microwave oven which comprises a heating chamber in which food is heated, a gas sensor for sensing a factor concerning the atmosphere where heating is effected in the heating chamber of the microwave oven and providing a voltage indicative of variations in the factor, first decision means for deciding, from timewise variations in the voltage derived from the gas sensor, what kind of food is being heated and determining the level where said gas sensor is provided a heating step signal, and second decision means for deciding whether a timewise variation in the output of said gas sensor after it reached a given detection level thereof is greater than a predetermined timewise variation, in conjunction with the kind of food which is deemed as having the lowest rate of timewise variation of said gas sensor output, and for deciding the sub-kind of the last-mentioned food.

In a preferred form of the present invention, there is provided a gas sensor within a passageway for outgoing air from the heating chamber. In addition to a switching means for controlling an enabling circuit for a microwave source such as a magnetron, a cook switch is provided which is common to all of the different kinds of food to be heated. A microcomputer is provided which generates a heating stop instruction for the enabling circuit for the microwave source in response to not only output signal from the gas sensor but also a stored program in the microcomputer. Based upon the rate of timewise variation in the output signal from the gas sensor, the microcomputer decides roughly what kind of food is being heated and then establishes an intended final level which the gas sensor shall reach at the end of heating. In conjunction with the kind of food which has the lowest rate of timewise variation in the output of said gas sensor, decision is made as to whether the timewise variation in the output signal of the gas sensor after reaching a given detection level ($V_{S1}$) is greater than a predetermined timewise variation, for deciding the sub-kind of the food, and a desired one of different constants ($N_K$) for additional heating is selected according to such second decision. Additional heating is effected for a length of time which is the product of the time necessary for the output signal from the gas sensor to reach said intended final level and the desired constant for additional heating so selected.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 1:
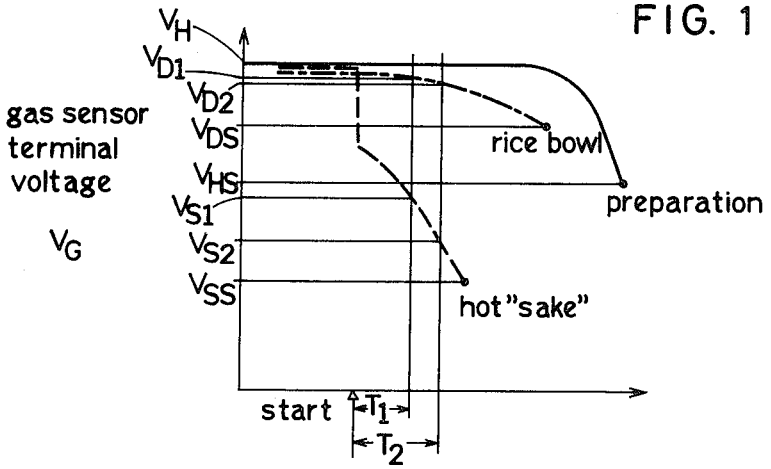
FIG. 1 is a graph for explaining the principle of food kind determination as suggested by the present invention.

To give a better understanding of the present invention, the operating principle of automation of cooking processes will be discussed first. FIG. 1 illustrates variances of a terminal voltage $V_G$ at a gas sensor 7 with time, based upon the kind of food. If a ratio of $V_{T2}$ to $V_{T1}$ is evaluated where $V_{T1}$ is the terminal voltage at the sensor when a time $T_1$ has expired after the beginning of heating and $V_{T2}$ is that when a time $T_2$ has expired, then the result of such evaluation reveals a significant difference depending upon the kind of food. Assuming that $T_1=30$ sec and $T_2=40$ sec, the ratio is less than 0.9 for hot "sake", 0.9 to 0.95 for prepared side dishes and rice bowls and 0.95 to 1.0 for prepared materials enclosed with a wrapping film. The kind of food is therefore decided by the ratio $V_{T2}/V_{T1}$ and its optimum detection levels $V_{HS}$, $V_{DS}$ and $V_{SS}$ are then determined as to $V_G$ to interrupt heating.

Figure 2:
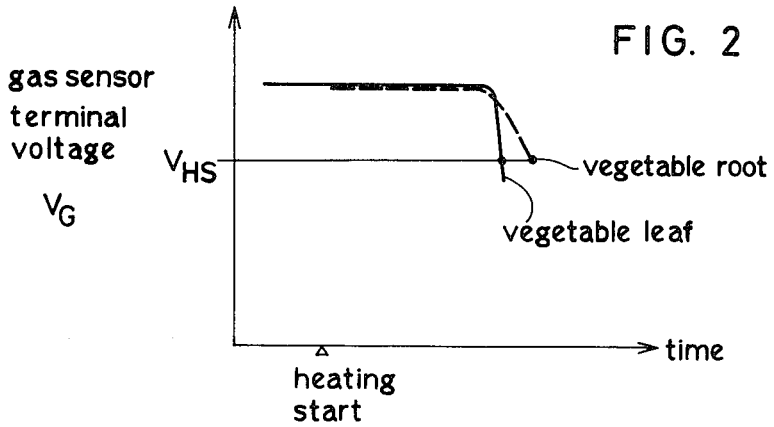
FIGS. 2 and 3 are graphs for explaining ways to solve prior problems by the present invention.

With the conventional type of microwave oven which has a plurality of cook keys each for an individual one of different kinds of food, "preheating" of food is generally differentiated for "vegetable leaf" and "vegetable root" and therefore requires at least two keys "preheating 1 (vegetable leaf)" and "preheating 2 (vegetable root). The reason is that vegetable leaves including spinach, cabbage, Chinese cabbage, etc. become fully scalded and softened with completion of preheating of those vegetables at about a heating temperature of 100° C., whereas preheating of vegetable roots including white potato, Irish potato, carrot, radish, etc. is not successful even at a heating temperature of 100° C. because thoese vegetables are not softened particularly inside thereof. FIG. 2 indicates this fact in terms of timewise variance of the terminal voltage $V_G$ of the gas sensor.

Figure 3:
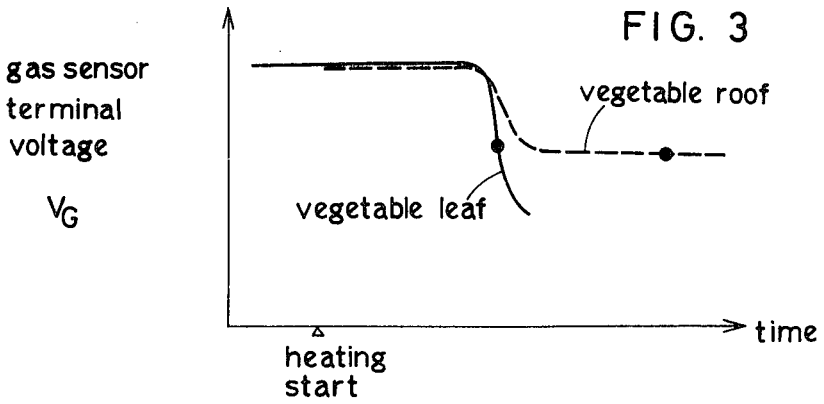

FIG. 3 shows experimental data viewed as to variances in the terminal voltage $V_G$ of the gas sensor, respectively, when the vegetable roots and vegetable leaves are heated within the microwave oven after being wrapped with wrapping films, indicating that both the vegetables trace substantially the same curve until the internal temperature of the wrapping film rises up to about 100° C. However, if 100° C. is reached and the wrapping film is blown out due to high steam pressure, then both the vegetables exhibit a significant difference in the rate of sudden change in the sensor voltage taking place when gases and water are scattered outside of the wrapping film. This is primarily due to the fact that the sensor voltage varies greatly the amount of such variance being large during heating of the vegetable leaves because of its higher freshness and water content than the vegetable roots, whereas the rate and amplitude of variance in the sensor output voltage are small during heating of the vegetable roots because they are generally served long after its harvest time and the outer skin still remain with a relatively small area of surface with an accompanying smaller content of water. The doubled circles in FIG. 3 show optimum points where heating is to stop.

The present invention relies upon the foregoing findings of the inventor's investigation. The major feature of an automatated microwave oven embodying the present invention wherein a single cook key is provided and one or more sensors including a gas sensor alone or a gas sensor and a thermistor in combination are provided for automatic control of food cooking, resides in that decision is made as to whether a timewise variation in the output of the gas sensor after it reaches a given detection level ($V_{S1}$) is greater than a predetermined timewise variation, in conjunction with the kind of food which is deemed as having the lowest rate of timewise variation of the gas sensor output, and for deciding the sub-kind of the last-mentioned food. A desired one of different constants ($N_K$) for additional heating is selected according such decision. After the output signal of the gas sensor reached the predetermined level, additional heating is effected for a length of time which is the product of the time necessary for the output signal from the gas sensor to reach the intended final level and the desired constant for additional heating so selected.

Comparison of FIGS. 1 and 2 reveals that preheating of the vegetable leaves and vegetable roots is generally classified into "preparation" in FIG. 1. After time $T_2$ passed upon the beginning of heating, this sequence of heating is deemed as falling in the category "preparation" and an intended final level where the gas sensor issues a heating end signal is determined simultaneously. This sequence traces either of the curves as shown in FIG. 2 for the vegetable leaves and vegetable roots. Based upon a timewise variation in the output signal of the gas sensor after reaching the first detection level ($V_{S1}$), decision is made as to whether food falls in the vegetable leaves or vegetable roots as well as selecting an appropriate constant ($N_K$) for the kind of the vegetables so decided.

Figure 4:
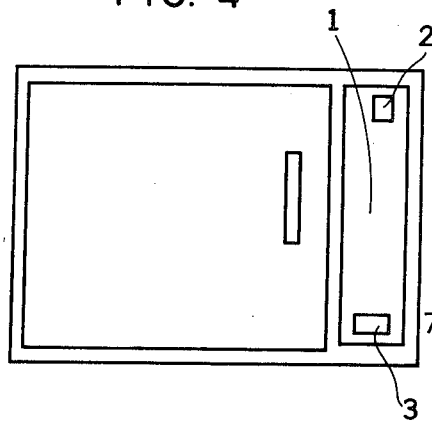
FIG. 4 is a front view of the appearance of a microwave oven according to an embodiment of the present invention.
Figure 5:
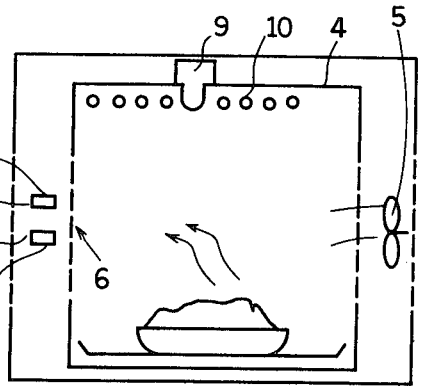
FIG. 5 is an elevational cross sectional view of the microwave oven as shown in FIG. 4.

FIG. 4 is a front view of the outer appearance of a microwave oven constructed according to an embodiment of the present invention. On an operational panel 1 there are disposed an "auto" cooking key 2 and a heating key 3. It is however obvious that both the keys 2 and 3 may be constructed as a single key. FIG. 5 is a cross sectional view of the microwave oven according to the embodiment of the present invention. A blower 5 is installed on one side of a heating chamber 4 and a gas sensor 7 and a thermistor 8 are disposed in an air outlet 6 on the other side of the heating chamber. The gas sensor 7 demonstrates a variance in resistance as a function of the condensation of exhaust gas from food, whereas the thermistor 8 shows a variance in resistance as a function of the temperature of the exhaust gas rising with the progress of heating. As is well known in the art, there are provided a magnetron 9 for radiating microwave waves and an infrared heater 10 for performing grilling of food.

Figure 6:
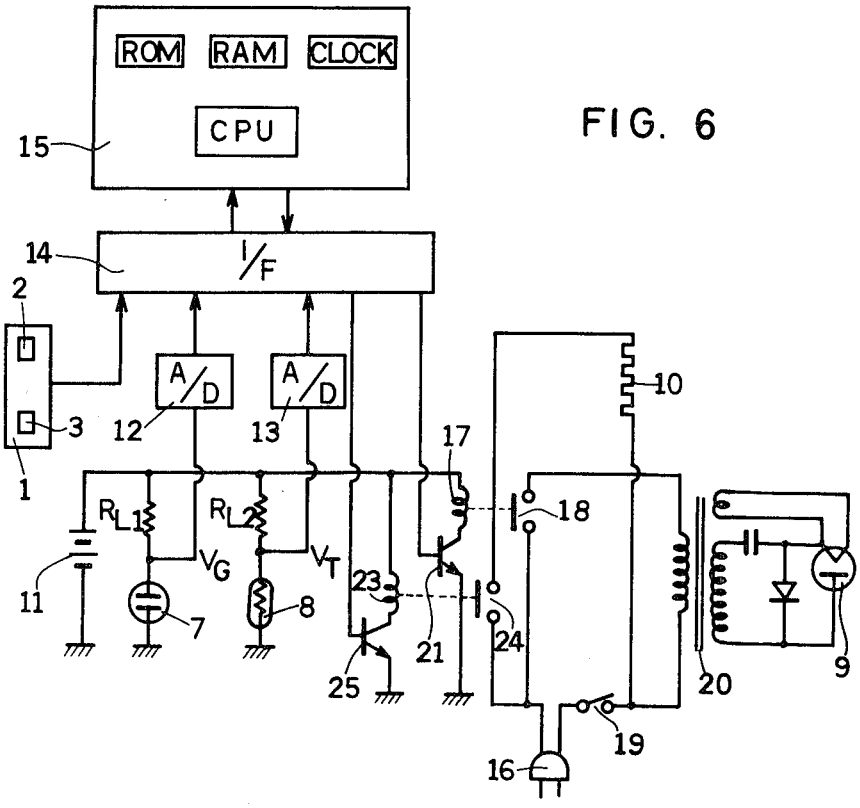
FIG. 6 is a circuit diagram of the above illustrated microwave oven.

FIG. 6 is a circuit diagram of the microwave oven according to the embodiment of the present invention. The gas sensor 7 is connected via a load resistor $R_{L1}$ and the thermistor 8 is connected via a load resistor $R_{L2}$ to a DC power source 11. The terminal voltage $V_G$ of the gas sensor 7 and the counterpart $V_T$ of the thermistor 8 are respectively supplied to a central processing unit CPU in a microcomputer 15 via analog-to-digital converters 12 and 13 and an input/output interface 14. The microcomputer 15 includes a ROM containing programs or the like, a RAM and a clock generator in addition to the CPU. Key signals on an operational panel 1 are also supplied to the microcomputer 15 via the interface 14. The magnetron 9 is enabled with a utility AC power source 16 by way of a contact 18 of a microwave exciting relay 17, a door switch 19, a booster transformer 20, etc. The grill heater 10 is energized with the utility AC power source 16 by way of a contact 24 of a heater exciting relay 23 and the door switch 19. Both the microwave exciting relay 17 and the heater exciting relay 23 are switched by the interface 14 and transistors 21 and 25 responsive to instructions from the CPU.

Operation of the above illustrated microwave oven will be made clear from a graph of FIG. 7 and a time chart of FIG. 8.

When the "auto" cooking key 2 is pressed and the heating key 3 is depressed, such keyed signals are fed to the CPU which in turn energizes the microwave exciting relay 17 to permit the magnetron 9 to oscillate and start microwave heating. The terminal voltage $V_{T1}$ of the gas sensor after time $T_1$ has gone by is loaded into the RAM. Furthermore, the terminal voltage $V_{T2}$ of the gas sensor when time $T_2$ has gone by after the beginning of heating is loaded into the RAM. The CPU calculates the ratio $V_{T2}/V_{T1}$ and then determines from such ratio $V_{T2}/V_{T1}$ what kind of food is in the process of being heated. Eventually, the CPU determines the optimum or final levels $V_{HS}$, $V_{DS}$ and $V_{SS}$.

Figure 7:
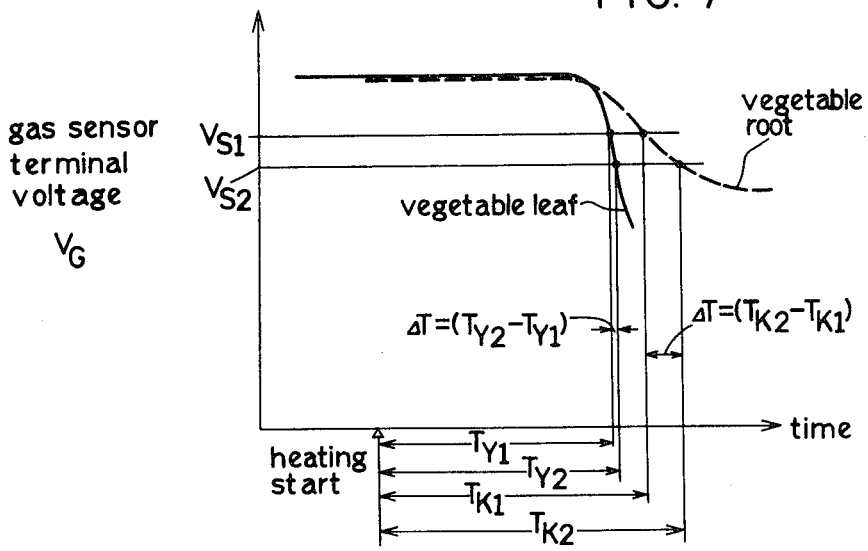
FIGS. 7 and 8 are characteristic charts for explaining operation of the above microwave oven.
Figure 8:
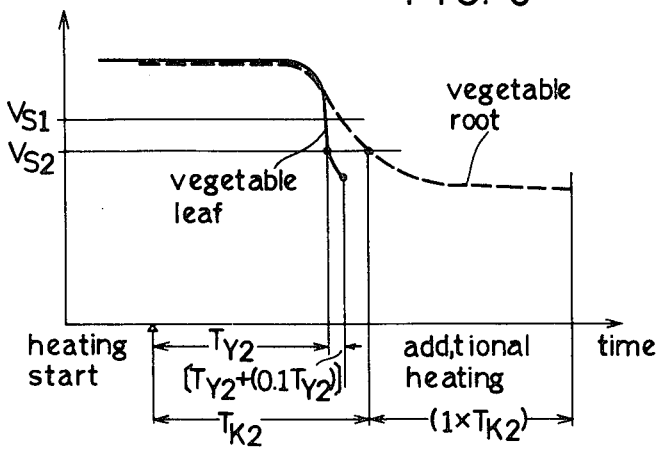

In conjunction with the food which is deemed as having a ratio $V_{T2}/V_{T1}$ from 0.95 to 1.0, a reading of the time length $T_{Y1}$ or $T_{K1}$ for the terminal voltage $V_G$ of the gas sensor to reach the first detection level $V_{S1}$ is stored in the RAM together with a reading of the time length $T_{Y2}$ or $T_{K2}$ for the same to reach a second detection level $V_{S2}$ after the beginning of heating, as is clear from FIG. 7. Under these circumstances, the CPU reads those two time lengths out of the RAM and calculates the difference $\Delta T$ between the two lengths.

$$\Delta T=(T_{Y2}-T_{Y1}) \text{ or } (T_{K2}-T_{K1})$$

This difference $\Delta T$ is compared with a reference value $\Delta T_K$ loaded into the ROM together with the programs for deciding whether the food now in cooking is the vegetable leaves or vegetable roots. An additional heating constant $N_K=0.1$ or 1, for example, when food is deemed as falling in the vegetable leaves, or vegetable roots, respectively.

The inventor's experiments assure that $\Delta T$ was 2–5 sec for the vegetable leaves and 30–50 sec for the vegetable roots with proper choice of $V_{S1}$ and $V_{S2}$ and precise decision between the vegetable root and vegetable leaf was achieved with $\Delta T_K=17$ sec. In response to such selection of the additional heating constant $N_K$ the food deemed as the vegetable leaf is subject to additional heating for a slight amount of time as determined by $(0.1\times T_{Y2})$ after the voltage $V_G$ of the gas sensor reached the level $V_{S2}$. The food deemed as the vegetable root is additionally heated for a larger amount of time (that is, $1\times T_{K2}$).

As an alternative, it is possible that the rate of variation in the output voltage of the gas sensor may be computed instead of using the differential time $\Delta T$ for the purpose of selecting the additional heating constant $N_K$.

It is further possible that, in the event that the output voltage of the gas sensor 7 becomed substantially fixed, the magnetron 9 may be de-energized even during the additional heating process after the output voltage of the gas sensor 7 reached the detection level $V_{HS}$. This measure prevents undesirable power dissipation when the food is water. In this instance, whether the food is water or not is decided by deciding whether the difference in the output voltage of the gas sensor 7 each sampling time $\Delta t$ is less than a predetermined value.

As noted earlier, the microwave oven embodying the present invention offers simplicity in the operational panel structure and provides higher degree of convenience of use for the user without requiring his judgements because it selects an appropriate program of heating and achieves the best result of cooking for different kinds of food upon simple actuation of the "auto" cooking key. Furthermore, based upon the difference in the timewise variance in the output voltage of the gas sensor, the heating sequence for "preparation" is subclassified with an appropriate constant for additional heating assigned for each of the different sub-kinds of food.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A microwave oven comprising:

a heating chamber in which food is heated, gas sensor means for sensing a factor concerning the atmosphere within said heating chamber of the microwave oven and providing a voltage indicative of variations in said factor, first decision means for deciding, from timewise variations in said voltage derived from said gas sensor means, what kind of food is being heated and determining the level of the voltage where said gas sensor, means is to provide a heating stop signal, and second decision means for deciding, in conjuction with the kind of food having the lowest rate of timewise variation of said gas sensor output, whether a timewise variation in the output of said gas sensor after reaching a given detection level thereof is greater than a predetermined timewise variation and for deciding the sub-kind of the last mentioned food from said variation.

2. A microwave oven comprising:

a heated chamber in which food is received, a microwave source connected to said heating chamber, gas sensor means within a passageway for outgoing air from said heating chamber for sensing a factor concerning the atmosphere within said heated chamber of the microwave oven and providing a voltage indicative of variations of said factor.

switching means for controlling an enabling circuit for said microwave source, a cook switch provided which is common to all of the different kinds of food to be heated, microcomputer means for generating a heating stop instruction to the enabling circuit of the microwave source in response to not only output voltage from said gas sensor means but also a stored program in the microcomputer, first decision means responsive to the rate of timewise variation in the output voltage from said gas sensor means for deciding roughly what kind of food is being heated and then establishing an intended final level which said gas sensor means shall reach at the end of heating, second decision means for deciding whether the timewise variation in the output signal of said gas sensor means after reaching a given detection level ($V_{S1}$) is greater than a predetermined timewise variation, for deciding the sub-kind of the food, and for selecting a desired one of different cooking time constants ($N_K$) for additional heating according to such second decision, and means for permitting said oven to effect additional heating for a length of time which is the product of the time necessary for the output signal from said gas sensor means to reach said intended final level and the desired constant for additional heating selected by said second decision means.

3. A method of heating a food until done comprising:

heating said food;

monitoring the gas discharge from said food with a gas sensor;

measuring the output from said gas sensor a first predetermined time after initiation of said step of heating to produce a first gas measurement;

measuring the output from said gas sensor a second predetermined time after said first gas measurement is made to produce a second gas measurement;

determining a measured gas sensor output ratio by dividing said second gas measurement by said first gas measurement;

comparing the measured gas sensor output ratio to a plurality of gas sensor output ratio ranges to determine the type of food being cooked;

determining the sub-kind of food being heated by conducting the steps of;

monitoring the time from initiation of heating which the output from said gas sensor reaches a first predetermined level to produce a first monitored time value, monitoring the time from initiation of heating which the output from said gas sensor reaches a second predetermined level to produce a second monitored time value, calculating the difference between said first and second monitored time values, comparing said difference with known time differences to determine the sub-kind of food being heated; and heating said food until done as determined by the type and sub-kind of said food.

4. The method of claim 3 further comprising:

determining when the output of said gas sensor reaches final vaule associated with the determined type of food, and heating said food until the output of said gas sensor reaches said final value.

5. The method of claim 4 further comprising:

determining a period of additional heating based on the determined sub-kind of said food;

heating said food after said gas sensor reaches said final value for said period of additional heating.

6. A system for heating a food until done comprising:

cooking means for heating said food;

gas sensor means for monitoring the gas discharge from said food and producing an output indicative thereof;

processor means for determining the type of food being heated by said cooking means from the change in the output of said gas sensor means over a predetermined period of time, said processor means further determining the sub-kind of said food from the time taken for the output of said gas sensor means to change a predetermined amount.

7. The system of claim 6 further comprising:

memory means for storing final gas sensor output values associated with each type of food;

said processor means comparing said output produced by said gas sensor means with the output value associated with the determined type of food and enabling said cooking means until a coincidence therebetween is reached.

8. The system of claim 7 wherein said memory means further contains time periods of additional heating associated with each sub-kind of food;

said processor means reading said time period for additional heating associated with said determined sub-kind of food and enabling said cooking means until said period has elapsed.

9. The system of claim 8 wherein said predetermined period of time is monitored by said processor means;

said processor means comparing the change in the output of said gas sensor means over said predetermined period of time with output change values associated with various types of food stored in said memory means to thereby determine the type of food.

10. The system of claim 8 wherein said predetermined amount of change in the output of said gas sensor means is monitored by said processor means;

said processor means comparing the time in which said predetermined amount of change occurs with time values stored in said memory means and associated with said sub-kinds of food to thereby determine the sub-kind of food.

11. The system of claim 6 wherein said system comprises a microwave oven and said cooking means comprises a magnetron tube.

12. The system of claim 11 further comprising a heating chamber, said gas sensor means monitoring the gas discharge within said heating chamber.

* * * * *